United States Patent [19]

Saitoh et al.

[11] 4,223,521

[45] Sep. 23, 1980

[54] WRISTWATCH MOVEMENT

[75] Inventors: Mituo Saitoh, Tokyo; Yasuo Kamiyama, Sayama, both of Japan

[73] Assignee: Citizen Watch Co., Ltd., Tokyo, Japan

[21] Appl. No.: 925,716

[22] Filed: Jul. 18, 1978

[30] Foreign Application Priority Data

Jul. 25, 1977 [JP] Japan ..... 52/99309

[51] Int. Cl.[3] ..... G04C 3/00; G04B 27/00

[52] U.S. Cl. ..... 368/204; 368/185

[58] Field of Search ..... 58/23 BA, 104, 63, 64, 58/90 B, 88 R, 88 B, 53, 85.5

[56] References Cited

U.S. PATENT DOCUMENTS 4,152,888 5/1979 Namiki et al. ..... 58/23 BA

*Primary Examiner*—Vit W. Miska

*Attorney, Agent, or Firm*—Jordan and Hamburg

[57] ABSTRACT

A wristwatch movement has a back cover formed with a battery replacement hole, and a base plate formed with a battery compartment in a substantially axial alignment with the battery replacement hole. An actuating lever has one end selectively engageable with a setting lever engaging with a winding stem extending through a radial bore of the base plate, and another end formed with a handling portion extending toward the battery compartment such that the handling portion can be manipulated through the battery replacement hole to cause the one end of the setting lever to disengage from the winding stem, to allow the winding stem to be pulled out of the radial bore.

6 Claims, 2 Drawing Figures

WRISTWATCH MOVEMENT

This invention relates to a watch movement structure, and more particularly to the structure and arrangement adapted for easy installation and removal of a winding stem in a wristwatch equipped with a battery hatch.

The recent popularization of battery-powered wristwatches has led to a large increase in wristwatches of the type in which the back cover of the case is equipped with a battery hatch for easy replacement of the battery.

In conventional wristwatches of the type described, the structure of a lever for installation and removal of a winding stem was disadvantageous for the following reasons. Namely, when installing or removing the winding stem, the lever was disposed such that it could only be manipulated after the troublesome operation of removing the back cover or the watchglass on the side of the dial. Owing to this arrangement, it was necessary to prepare a variety of levers due to differences in the size of the outside diameter and the thickness of the dial and in the structure of the case even in the instance of movements of the same type.

The present invention therefore seeks to overcome the shortcomings encountered in the prior art through the provision of a structure for the installation and removal of a winding stem in a wristwatch which makes it possible to install and remove a winding stem by means of a simple operation.

To this end, the handling portion of an actuating lever for the installation and removal of a winding stem is disposed in close proximity to a battery compartment such that the lever can be manipulated through a battery replacement hole in the back cover of the wristwatch case, the battery replacement hole being obtained by removing a battery hatch which can be attached and detached in a comparatively easy manner.

Figure 1:
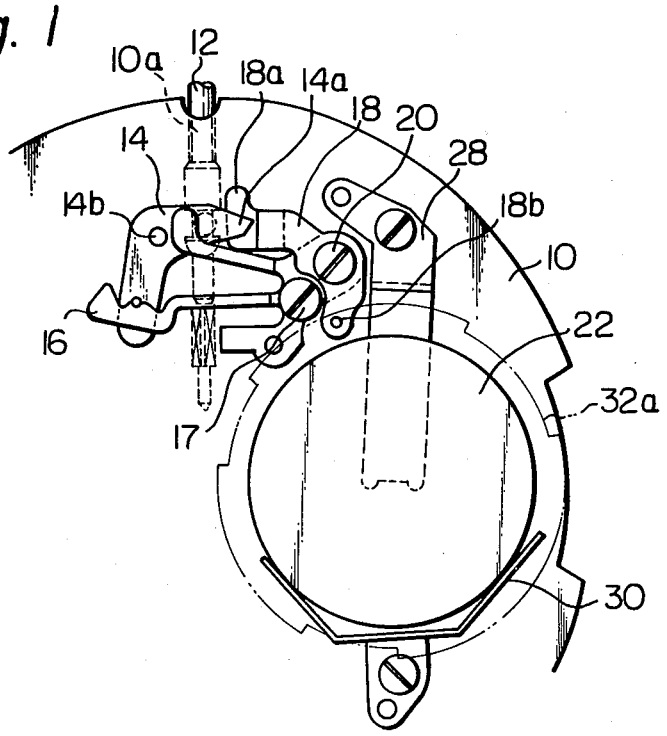
Figure 2:
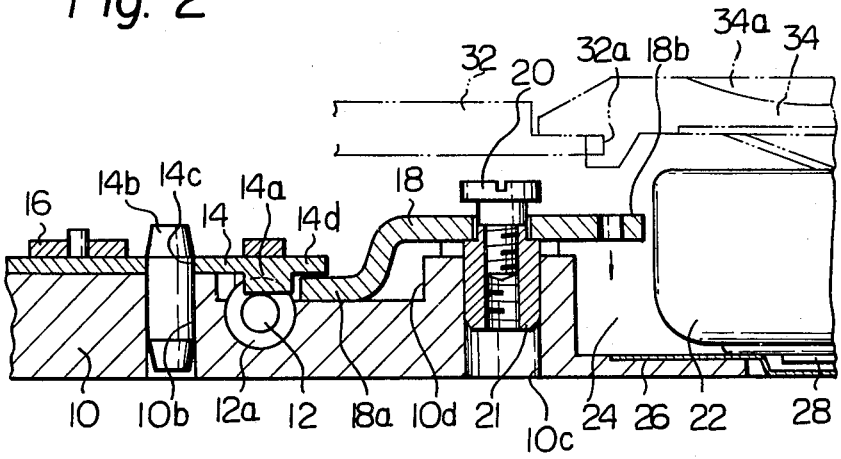

In the accompanying drawings, in which:

FIG. 1 is a plan view of the principal portion of a battery-powered wristwatch movement illustrative of an embodiment of the present invention; and FIG. 2 is a cross-sectional view of FIG. 1.

FIG. 1 is a plan view of the principal portion of a battery-powered wristwatch movement illustrative of an embodiment according to the present invention, and FIG. 2 is a cross-sectional view of FIG. 1. The movement comprises a base plate 10 having at its one surface formed with a battery compartment 24 adapted to accommodate a battery 22 therein, and a back cover 32 having a battery replacement hole 32*a* substantially concentric with the battery compartment 24 to permit replacement of the battery 22 therethrough. The base plate 10 has a radially extending bore 10*a*, in which winding stem 12 is slidably and rotatably disposed. A setting lever 14 is disposed on one surface of the base plate 10 and has on its intermediate portion formed with a bore 14*c* through which a pivot shaft 14*b* is loosely fitted, with the pivot shaft 14*b* extending through bore 10*b* of the base plate in a direction perpendicular to the axis of the winding stem 12 to allow pivotal movement of the winding stem 12 in a plane parallel to the base plate 10 when the winding stem 12 is depressed or pulled in the bore 10*a*. The setting lever 14 has its one end formed with a dowel 14*a* engaging a groove 12*a* of the winding stem 12. A pressure plate 16 is fixed to the one surface of the base plate by means of screw 17 and serves as a spring member for restraining the setting lever 14 in an axial direction of the movement and also retraining the winding stem 12 through the setting lever 14 at each of several pulled-out positions. An actuating lever 18 is rockably supported on the base plate 10 at the same side as the setting lever 14 engaging the winding stem 12, by means of a supporting member such as a screw 20 screwed into a support pin 21 fitted in bore 10*c* axially extending through base plate 10. The actuating lever 18 has at its one end formed with a bent portion or engaging portion 18*a* disposed in a recessed portion 10*d* of the base plate 10 and engageable with a tip 14*d* of the setting lever 14. Another end 18*b*, which serves as a handling portion, of the actuating lever 18 radially extends toward the battery compartment 24 and is adapted to be moved axially of the movement in a direction as shown by an arrow in FIG. 2 by some suitable means (not shown). It is clear from the drawings that the setting lever 14, pressure plate 16, lever 18, etc. are disposed on the same side of base plate 10, and that this makes it possible to dispose the handling portion 18*b* of lever 18 in close proximity to battery 22 which is also located on the upper side of the plate 10. Reference numeral 26 denotes an insulating seat, and 28 a battery retention spring adapted to provide electrical contact for the negative electrode of the battery, the spring 28 being connected to and supported by a circuit board (not shown). Designated at 30 is a spring which pressures the side of battery 22 to provide electrical connection for the positive electrode of the battery, and designated at 34 is a battery hatch for battery replacement having a coin groove 34*a* and being attached to back cover 32 by a bayonet mechanism or by being screwed into place.

The installation and removal of winding stem 12 is accomplished as follows. First, battery hatch 34 is removed by a coin or the like, thereby exposing the horizontal portion of battery 22 which is visible through the hole 32*a*. Using a timepiece tool such as a screw driver or tweezers, the handling portion 18*b* of lever 18 adjacent the battery is pressed downwardly in the direction of the arrow shown in FIG. 2. This operation, owing to the tip 18*a* of lever 18 disposed below tip 14*a* of setting lever 14, causes the lever 18 to raise the setting lever 14 with screw 20 acting as a fulcrum, thereby dowel 14*a* from groove 12*a* of stem 12 so that winding stem 12 can be readily removed and taken out of the wristwatch case (not shown), when it is desired to disassemble the movement from the wristwatch case.

Thus, according to the present invention as described above, the handling portion of a lever for the installation and removal of a winding stem is disposed in close proximity to a battery so as to enable installation and removal of the winding stem through a hole which is formed in the back cover of the case for the attachment of a battery hatch that allows replacement of the battery. Accordingly, the structure of the present invention allows manipulation of the lever for installation and removal of the winding stem to be accomplished by the simple operation of removing the battery hatch by a coin or the like, whereas the structure according to the prior art accomplishes this by necessitating the removal of the back cover or the watchglass on the side of the dial. The present invention no longer requires the troublesome removal of these parts when, for example, the winding stem is to be removed during repair or inspection work in which a watch movement is taken out of a watch case. Since one kind of lever for installation and removal of the winding stem suffices regardless of differences in the diameter and thickness of the watch dial, a designer can decide the size of the dial without their being any restriction upon the design of the dial itself. It is also possible to minimize labor with regard to the machining of the lever, management of the manufacturing process and after-service for parts management.

What is claimed is:

1. A movement for a wristwatch powered by a battery and having a back cover formed with a battery replacement hole to which a battery hatch is removably mounted, comprising:

a base plate having on its one surface formed with a battery compartment in a substantially axial alignment with the battery replacement hole, and a radially extending bore;

a winding stem slidably and rotatably disposed in the radially extending bore of said base plate, and having a groove portion formed at an intermediate part of said winding stem;

a setting lever pivotally mounted on said one surface of said base plate, said setting lever having one end formed with a dowel portion normally engaging said groove portion of said winding stem, and a tip portion; and an actuating lever rockably mounted on said one surface of said base plate, said actuating lever having its one end formed with an engaging portion extending below said tip portion of said setting lever, and another end formed with a handling portion extending toward said battery compartment such that said handling portion can be actuated in an axial direction of said movement through said battery replacement hole to cause said engaging portion to move said tip portion in a direction away from said groove portion to allow removal of said winding stem out of said base plate.

2. A movement as claimed in claim 1, in which said engaging portion comprises a bent portion, and said base plate has a recessed portion formed on its one surface for accommodating said bent portion of said actuating lever such that an upper surface of said bent portion is substantially aligned with the one surface of said base plate.

3. A movement as claimed in claim 1 or 2, further comprising a pressure plate serving as a spring for restraining said setting lever in an axial direction of said movement and retaining said winding stem through said setting lever in a given horizontal plane.

4. A movement for a wristwatch powered by a battery and having a back cover formed with a battery replacement hole, comprising:

a base plate having on its one surface formed with a battery compartment in a substantially axial alignment with the battery replacement hole, and a radially extending bore;

a pivot shaft fixedly supported by said base plate and extending in a direction perpendicular to the radially extending bore;

a supporting member fixedly supported by said base plate and extending in the same direction as said pivot shaft;

a winding stem slidably and rotatably disposed in the radially extending bore of said base plate, and having a groove portion formed at an intermediate part of said winding stem;

a setting lever disposed on the one surface of said base plate, said setting lever having on its intermediate portion formed with a bore through which said pivot shaft is loosely fitted, one end formed with a dowel portion normally engaging said groove portion of said winding stem, and a tip portion; and an actuating lever rockably supported on said one surface of said base plate, said actuating lever having its intermediate portion formed with a bore through which said supporting member extends, its one end formed with an engaging portion engaging said tip portion of said setting lever, and another end formed with a handling portion extending toward said battery compartment such that said handling portion can be actuated in an axial direction of said movement through said battery replacement hole to cause said engaging portion to move said tip portion in a direction away from said groove portion to allow removal of said winding stem out of said base plate.

5. A movement as claimed in claim 4, in which said engaging portion comprises a bent portion, and said base plate has a recessed portion formed on its one surface for accommodating said bent portion of said actuating lever such that an upper surface of said bent portion is substantially aligned with the one surface of said base plate.

6. A movement as claimed in claim 4 or 5, further comprising a pressure plate serving as a spring for restraining said setting lever in an axial direction of said movement and retaining said winding stem through said setting lever in a given horizontal plane.

* * * * *